United States Patent [19]

Dal Busco

[11] Patent Number: 4,815,053

[45] Date of Patent: Mar. 21, 1989

[54] ROTATING-BEZEL WATCH

[75] Inventor: Giancarlo Dal Busco, Courrendlin, Switzerland

[73] Assignee: Remy Montavon S.A., Switzerland

[21] Appl. No.: 146,332

[22] Filed: Jan. 21, 1988

[51] Int. Cl.[4] ..... G04B 37/00

[52] U.S. Cl. ..... 368/294; 368/295

[58] Field of Search ..... 368/294–296, 368/21, 22, 27, 223, 233

[56] References Cited

U.S. PATENT DOCUMENTS

| | | | |
|---|---|---|---|
| 3,271,945 | 9/1966 | Anderson | 368/295 |
| 3,431,722 | 3/1969 | Haas | 368/295 |
| 3,512,353 | 5/1970 | Blum | 368/295 |
| 3,520,129 | 7/1970 | Schneider | 368/295 |
| 3,583,151 | 6/1971 | Tissot | 368/295 |
| 4,244,044 | 1/1981 | Olsson | 368/294 |
| 4,253,177 | 2/1981 | Hafner | 368/294 |
| 4,420,264 | 12/1983 | Murata | 368/294 |

FOREIGN PATENT DOCUMENTS 3205821 7/1983 Fed. Rep. of Germany .

*Primary Examiner*—Vit W. Miska

*Attorney, Agent, or Firm*—Kane, Dalsimer, Sullivan, Kurucz, Levy, and Richard

[57] ABSTRACT

The rotating bezel of synthetic material forms, together with a ring of synthetic material provided with clicks formed integrally with said ring, and together with a metallic tension ring, a subassembly constituting a constructional unit which is easily fitted to or removed from the case. If the case is of synthetic material, the click carrier ring can be dispensed with by complete integration into the case.

10 Claims, 7 Drawing Sheets

ROTATING-BEZEL WATCH

FIELD OF THE INVENTION

The present invention relates to a rotating-bezel watch comprising a rotating bezel mounted for rotation about a cylindrical bearing surface on a fixed bezel forming part of the middle of the case, said rotating bezel being retained axially on the middle by a radial annular bearing surface and being provided with sawtooth toothing cooperating with clicks formed integrally with a part fastened to the middle, in such a manner as to allow the turning of the rotating bezel in one direction only and to hold said rotating bezel in the position in which it has been placed manually.

PRIOR ART

A watch of this kind is known from the patent No. DE 3 205821. In this watch, the radial bearing surface of the rotating bezel consists of an attached ring fixed by means of screws. This attached ring is retained by the shoulder of a ring fixed to the middle. The sawtooth toothing of the rotating bezel is an edge toothing formed on the attached ring, said edge toothing cooperating with clicks in the form of tongues cut out and raised ina metal ring mounted free in a socket in the middle. It is relatively complicated to fit a rotating bezel of this kind. It is first necessary to place in position the ring provided with the clicks, then to place in position the ring provided with the sawtooth toothing, thereupon to drive the retaining ring over the middle, and finally to place the bezel in position and fasten the toothed ring to the bezel by means of screws. It is difficult to envisage the changing of the rotating bezel, because it appears very difficult to remove the ring regaining the middle.

The present invention seeks to provide a rotating bezel of simpler construction, which is adapted to be easily fitted to and removed from the watchcase. In particular, it seeks to allow simple and rapid replacement of the rotating bezel during servicing.

According to a first aim of the invention the radial annular bearing surface of the rotating bezel is formed by one of the side faces of an internal groove, said ring fastened to the middle is a metal tension ring, and the clicks are of synthetic material and directed radially.

In order to place the rotating bezel in position, after the tension ring has first been inserted into its, it is simply pressed over the cylindrical bearing surface of the middle.

As a rule, in the case of a metal case, the clicks are preferably formed integrally with a ring of synthetic material, which in turn is surrounded by the tension ring. The rotating bezel, the tension ring and the click carrier ring of synthetic material form a preassembled subassembly which can easily be fitted onto the middle of the case by simple pressure. The friction between the synthetic material of the ring and the middle, in conjunction with the tension ring, ensures very good fastening of the subassembly to the case. This subassembly can also be easily removed without special tools.

If the case is of synthetic material, it is nevertheless possible to dispense with the click carrier ring by forming the clicks directly in the material of the case. The use of the clicks also makes it possible to eliminate corrosion completely.

The present invention also seeks to provide a construction which is free from axial play and which, if desired, makes it possible to mount the rotating bezel on the middle by simple engagement.

SUMMARY OF THE INVENTION

To this end, the toothing of the rotating bezel is a radial toothing formed directly in the rotating bezel, and the clicks on the click carrier ring work radially.

The radial arrangement of the toothing and clicks makes it possible to reduce, or even to elminate, axial play and consequently to protect the toothing and the clicks against dust. If desired, the rotating bezel and the click carrier ring may be engaged over the middle from below, thus making it possible to have a relatively tall bearing surface and consequently more secure and easier fastening of the rotating bezel.

Both the click carrier ring and the rotating bezel may be made either of metal or of synthetic material. If the click carrier ring is of synthetic material, it may be molded onto the middle.

BRIEF DESCRIPTION OF THE DRAWINGS

The accompanying drawing illustrates by way of example some embodiments of the invention.

DESCRIPTION OF THE PREFERRED EMBODIMENTS.

Figure 1:
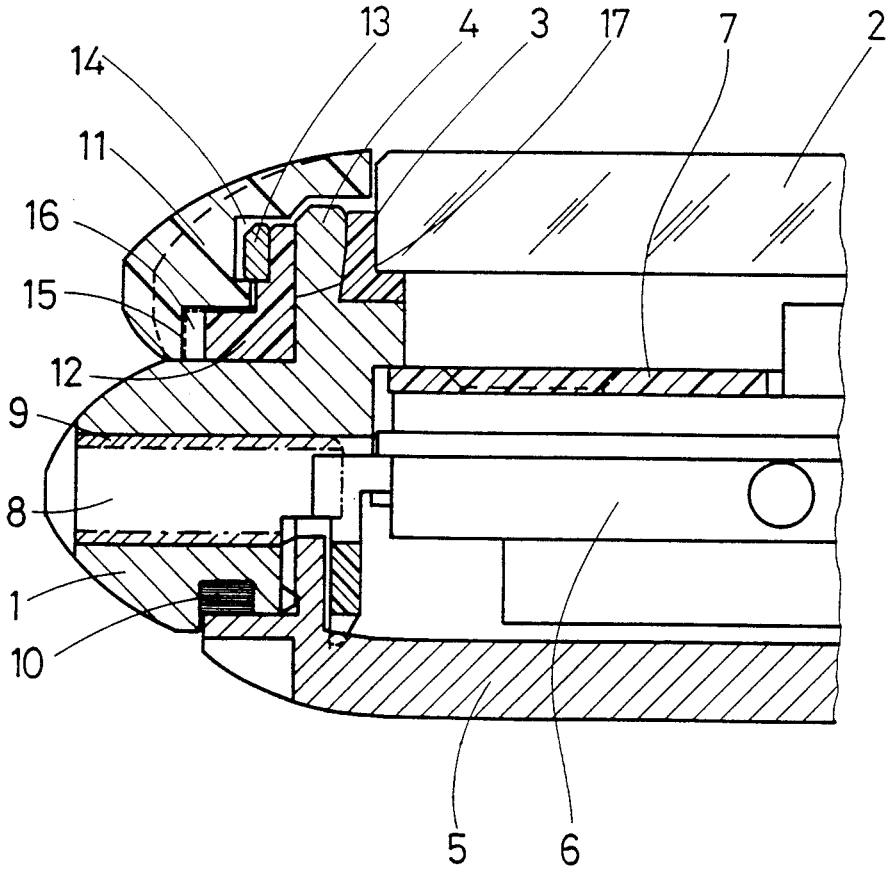
FIG. 1 is a partial view in axial section of a watchcase according to a first embodiment.

The watch shown in FIG. 1 comprises a metal middle-bezel unit 1 closed on one side by a crystal 2 fixed by means of a seal 3 in the crystal groove in the fixed bezel 4 forming part of the middle-bezel unit, and on the other side by a metal back 5. This case holds a movement 6 carried by a cage ring 7 of synthetic material and supporting a dial 25. The movement 6 is accessible through the middle by way of a stem passage 8 line by a tube 9. The hands setting stem and its crown are now shown. The back is sealed by a packing 10.

This watch also carries a rotating bezel 11 of synthetic material, which is mounted on a click carrier ring 12 of syntehtic material and retained axially on said ring 12 by a brass ring 13 of rectangular section driven onto a cylindricl bearing surface on the ring 12. The rotating bezel 11 is for this purpose provided with a groove 14 in which the brass ring 13 is engaged. The rotating bezel 11 is provide in its lower portion with an internal sawtooth toothing 15 cooperating radially with four clicks formed integrally with the ring 12 and distributed over the circumference of the ring 12. One of these clicks 16 is visible in FIG. 1. The rotating bezel 11, the click carrier ring 12, and the brass ring 13, which serves as a tension ring, form a preassembled subassembly which is easily fixed by and by insertion onto the cylindrical bearing surface 17 of the middle-bezel unit.

Figure 2:
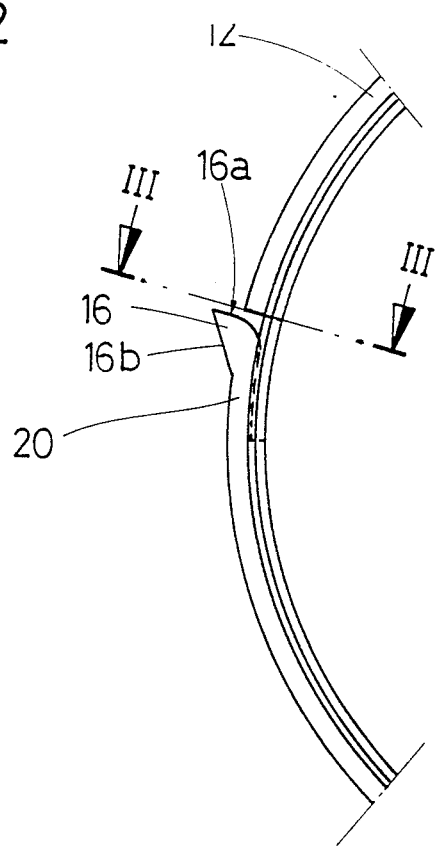
FIG. 2 is a detail view of a part of the click carrier ring.
Figure 3:
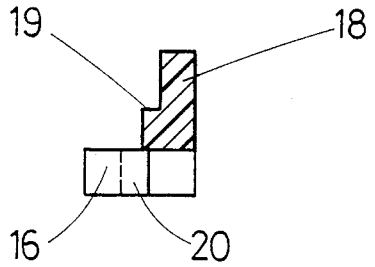
FIG. 3 is a view in section on the line III—III in FIG. 2.

The shape of the clicks 16 of the click carrier ring 12 is shown in FIGS. 2 and 3, FIG. 2 showing the ring 12 viewed from above. The ring 12 consists of a cylindrical wall 18 provided on the outside with a shoulder 19 forming an axial stop for the tension ring 13. Each click 16 comprises a resilient arm 20 cut out from the bottom half of the ring 12, this arm 20 widening at its end to form a click beak having a radial face 16*a* on the clockwise direction side and an oblique face 16*b* on the other side. When the user turns the rotating bezel 11 in the clockwise direction, the teeth of the sawtooth toothing 15 on the rotating bezel slide over the oblique face 16*b*, pushing back the click 16, whose resilient arm 20 bends.

The rotating bezel cannot be turned in the opposite direction because the radial face 16*a* of the clicks comes to strike agains the radial face of the sawteeth of the toothing 15. The use of four clicks 16 makes it possible to center the rotating bezel and to obtain a click action which is gentle, accurate and also reliable.

The subassembly composed of the rotating bezel 11, the tension ring 13, and the click carrier ring 12 is made in the form of a constructional unit which is easy to mount on or remove from a case, which not only simplifies the fitting of the rotating bezel in the factory, but also very greatly simplifies servicing. In addition, it is possible to equip a case with a plurality fo types of bezels, because of the ease with which the rotating bezel can be fitted and removed.

Figure 4:
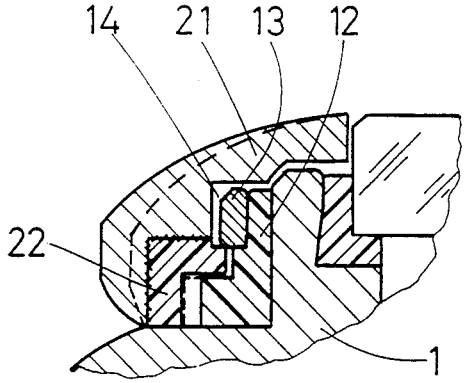
FIG. 4 is a partial view in axial section of a second embodiment.

The form of construction described is also applicable to a rotating bezel of metal. FIG. 4 shows a rotating bezel 21 of this kind, which is made of metal. This metal bezel 21 differs from the rotating bezel 11 of FIG. 1 only in that it has a recess onto which is inserted a ring 22 made of synthetic material and provided with the sawtooth toothing 115, said ring also forming the bottom wall of the groove 14. In other respects this embodiment is similar to that shown in FIG. 1.

Figure 5:
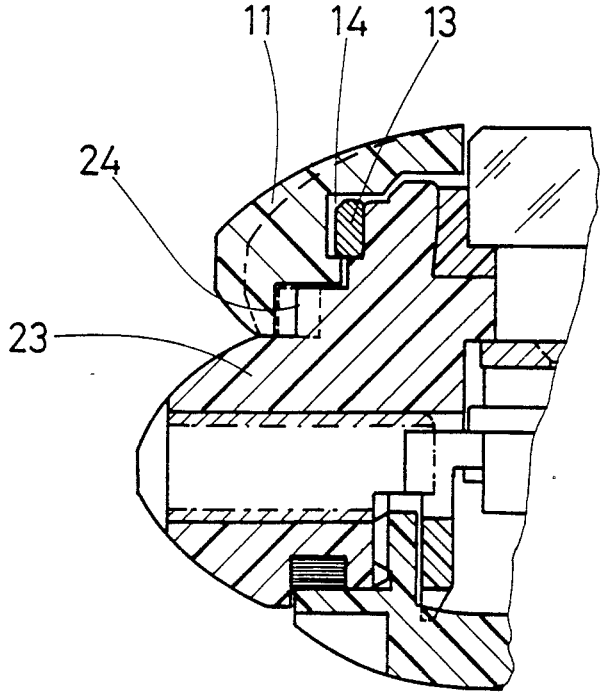
FIG. 5 is a partial view in axial section of a watchcase according to a third embodiment.

FIG. 5 shows a third embodiment, in which the watchcase comprises a middle-bezel unit 23 of synthetic material. This makes it possible to dispense with the click carrier ring 12, which in a manner of speaking is integrated into the middle-bezel unit 23. Like the clicks 16, the clicks 24 are formed directly from the material of the middle 23. The profile of the middle-bezel unit in the portion forming the rotating bezel 11 corresponds to the profile of the click carrier ring in FIG. 1, so that it is possible to use the same rotating bezel 11 as in the first embodiment.

It is obviously possible to mount the bezel 21 shown in FIG. 4 on the middle-bezel unit 23 of FIG. 5.

Figure 6:
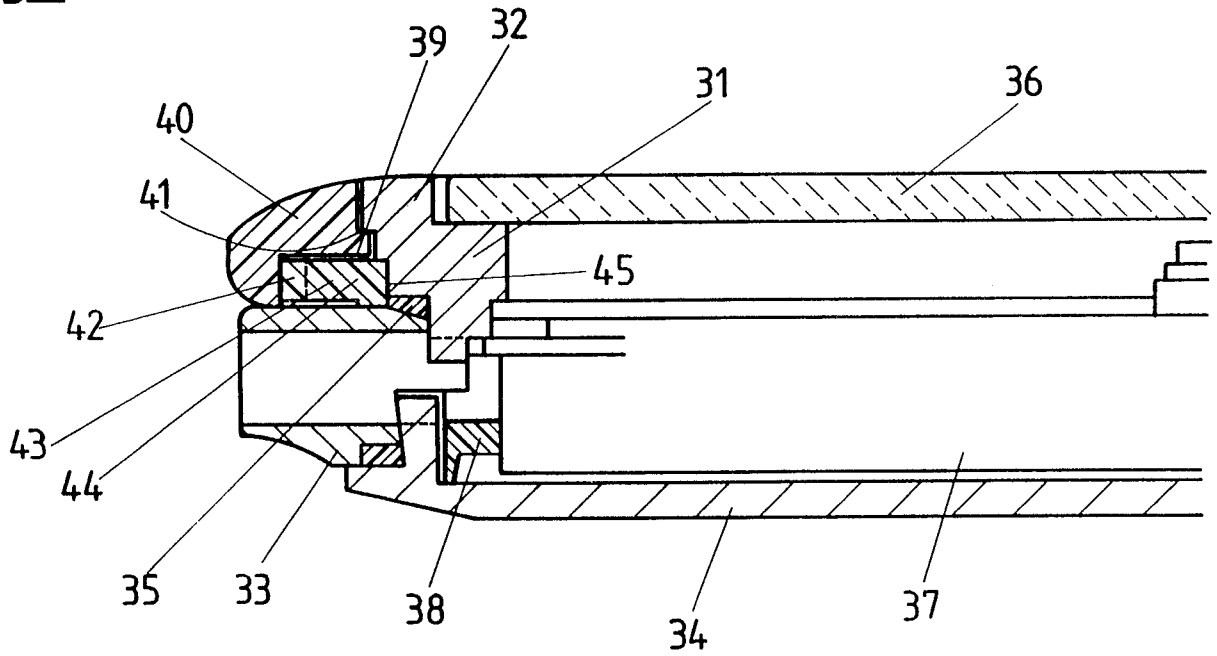
FIG. 6 is an axial half-section of a watch according to a fourth embodiment.

The watch shown in FIG. 6 comprises a two-piece middle-bezel unit, namely a top part 31 including the fixed bezel 32 and a bottom part 33 to which a back 34 is fixed. The part 31 is engaged in a notch in the part 33 with the interposition of a seal 35. A flat crystal 26 is fixed in the bezel 32. The case formed in this manner holds a movement 37 supported by a movement carrier ring 38. On the outside the bezel 32 has an axial bearing surface 39 retaining a rotating bezel 40 provided with a corresponding axial bearing surface 41. The rotating bezel 40, which is of metal or synthetic material, has an internal radial sawtooth toothing 42. This toothing cooperates with four clicks, such as 43, on a click carrier ring 44 fixed on a cylindrical bearing surface 45 on the part 31 of the iddle. This click carrier ring 44 is of metal or synthetic material. It may be fixed by adhesive bonding to the bearing surface 45 or be driven onto the latter. It is in addition gripped between the bottom part 33 of the middle and a bearing surface on the top part 31. The clicks 43 are formed integrally with the click carrier ring 44, to which they are connected by a resilient tangential arm 45.

Figure 8:
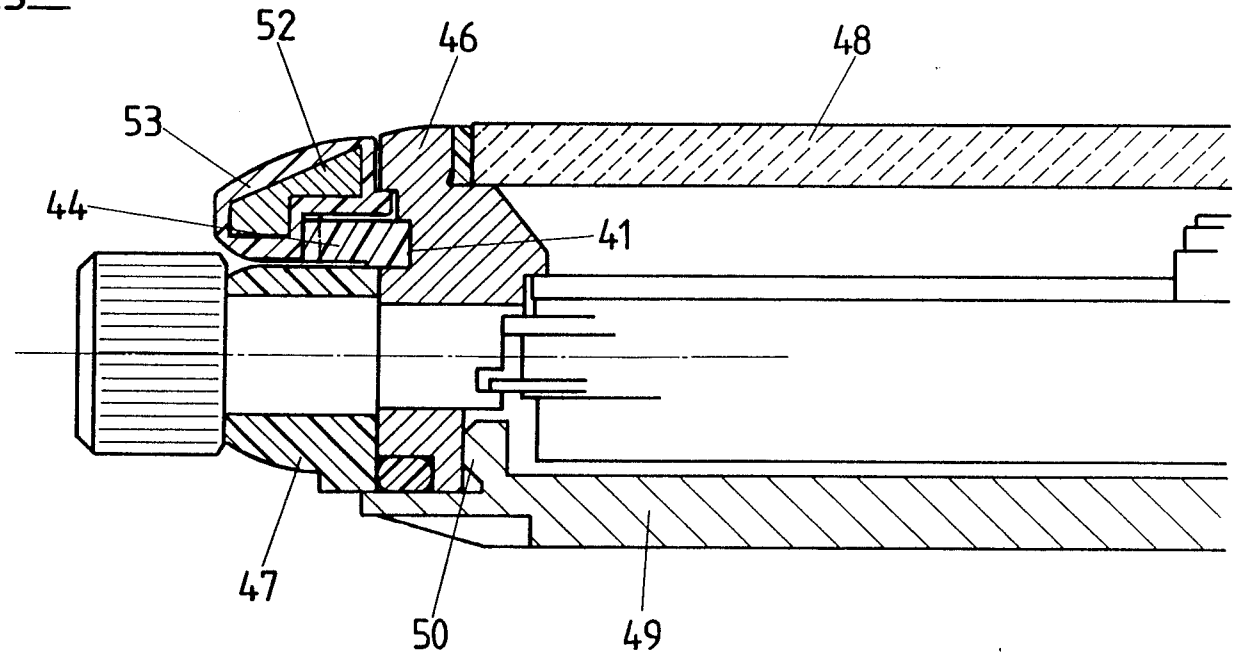
FIG. 8 is an axial half-section of a fifth embodiment.

The watch according to the fifth embodiment shown in FIG. 8 comprises a metallic one-piece middle-bezel unit 46 surrounded by an outer middle 47 of synthetic material. The case is completed by a flat crystal 48 and a back 49 provided with a threaded portion 50 by which it is screwed to the middle-bezel unit. The click carrier ring 44 is of synthetic material and is molded into a groove 51 in the middle-bezel unit 46. The rotating bezel consists of a metal ring 52, aorund which the actual rotating bezel 53 of synthetic material is molded. The latter is retained on the middle-bezel unit 46 in the same way as in the fourth embodiment.

Figure 9:
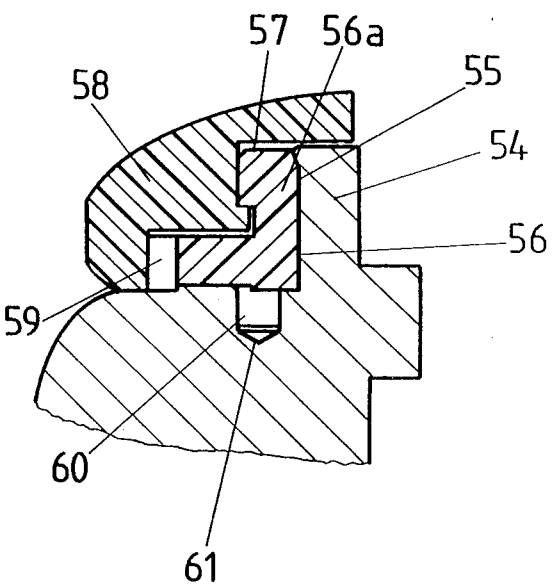
FIG. 9 is a partial axial section of a sixth embodiment.
Figure 7:
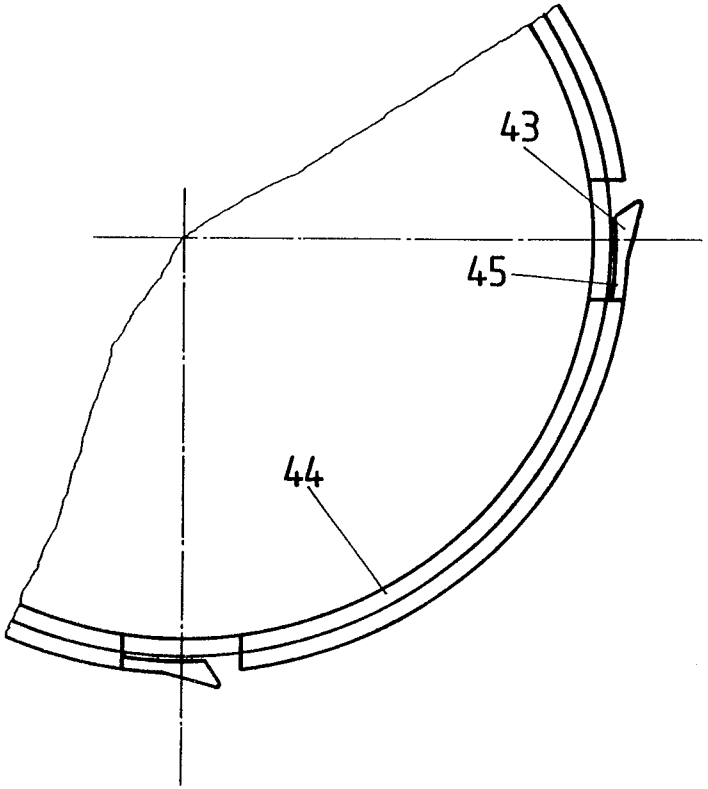
FIG. 7 is a plan view of a part of the click carrier ring of the embodiment shown in FIG. 6.

The sixth embodiment shown in FIG. 9 comprises a one-piece middle-bezel unit 54 provided with a cylindrical bearing surface 55 on which a click carrier ring 56 of synthetic cmaterial is fastened by adhesive bonding. In relation to the click carrier ring 44, the click carrier ring 56 has an upwardly directed axial extension 56*a* on which is formed an axial bearing surface 57, against which the rotating bezel 58 of synthetic material, which here covers the fixed bezel 54, is retained. The rotating bezel 58 provided in this case also has a radial toothing 59. The click carrier ring 56 is in addition provided with a centering pin 60 engaged in a hole 31 in the middle-bezel unit 54.

Figure 10:
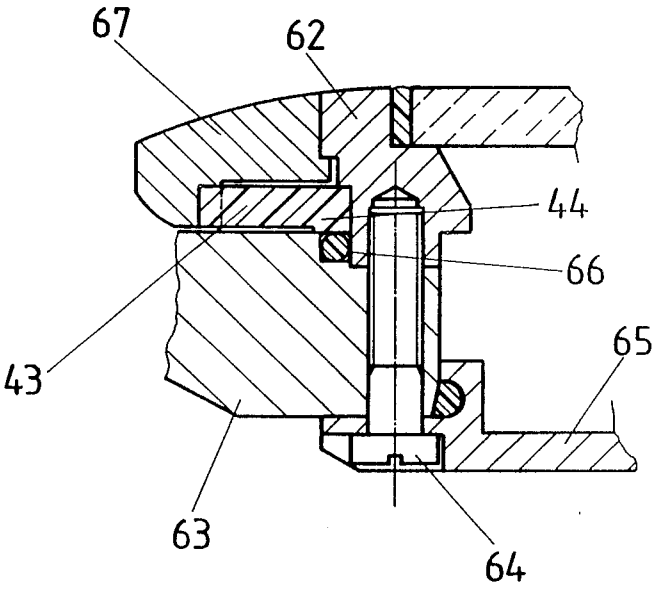
FIG. 10 is a partial axial section of a seventh embodiment.

In a seventh embodiment shown in FIG. 10 the click carrier ring 44, preferably of synthetic material, is fixed by being gripped between a fixed bezel 52 and a middle 63, which are drawn towards one another by screws 64, which at the same time fasten a back 65. Sealing between the fixed bezel 62 and the middle 63 is achieved with the aid of a packing 66 disposed under the click carrier ring 44 and compressed by the latter. The rotating bezel 67 is similar to the rotating bezel 40 in the fourth embodiment.

Figure 11:
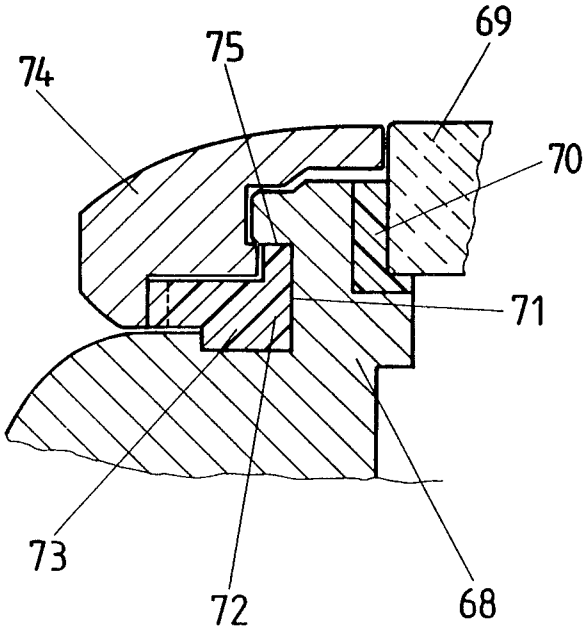
FIG. 11 is a partial axial section of an eighth embodiment, provided with a split click carrier ring.

The watch according to the eighth embodiment shown in FIG. 11 comprises a one-piece middle-bezel unit 68, in which a flat crystal 69 is mounted with the interposition of a packing 70 having an L-shaped profile. The middle-bezel unit 68 has an annular groove 71 receiving a click carrier ring 72 which is provided with a radial slock and whose elasticity enables it to open slightly for the purpose of insertion into the groove 72. The click carrier ring 72 is retained in respect of rotation by snugs 73 engaging in sockets in the middle-bezel unit 68. The watch is provided with a rotating bezel 77 similar to the rotating bezel 58 shown in FIG. 9. This rotating bezel is however retained axially in this case by the top edge 75 of the groove 71. The clicks are identical to the clicks 43 in the preceding embodiments.

I claim:

1. A rotating-bezel watch comprising a case, a rotating bezel mounted for rotation about a cylindrical bearing surface on a fixed bezel forming part of the middle of the case, said rotating bezel being retained axially on the middle by a radial annular bearing surface cooperating with a ring fastened to the middle and being provided with sawtooth toothing cooperating with clicks formed integrally with a part fastened to the middle, in such a manner as to allow the turning of the rotating bezel in one direction only and to hold said rotating bezel in the position in which it has been placed manually, in which watch said radial annular bearing of the rotating bezel is formed by one of the side faces of an internal groove, said ring fastened to the middle is a metal tension ring, and the clicks are of synthetic material and directed radially.

2. A rotating-bezel watch as claimed in claim 1, wherein the clicks are formed integrally with a ring of synthetic material gripped between said cylindrical bearing surface of the middle and the tension ring.

3. A rotating-bezel watch as claimed in claim 2, wherein the rotating bezel is of metal and its sawtooth toothing is formed on a ring of synethic material fixed in the rotating bezel.

4. A rotating-bezel watch as claimed in claim 1, wherein the case is of syntehtic material and the clicks are formed integrally with the case.

5. Rotating-bezel watch comprising a case, a rotating bezel mounted for rotation about a cylindrical bearing surface on a fixed bezel forming part of the middle of the case, said rotating bezel having an axial bearing surface by which it is retained axially on an axial annular bearing surface on said fixed bezel and being provided with sawtooth toothing cooperating with clicks formed integrally with a fixed click carrier ring in such a manner as to allow the turning of the rotating bezel in one directon only and to hold said rotating bezel in the position in which it has been placed manually, the toothing of the rotating bezel being a radial toothing formed directly in the rotating wheel and the clicks of the click carrier ring working radially.

6. A watch as claimed in claim 5, wherein the middle is composed of two parts fixed by slotting into one another, and wherein the top part including the fixed bezel has a cylindrical bearing surface of reduced diameter, on which the click carrier ring is fixed by adhesive bonding or by being driven onto it.

7. A watch as claimed in claim 5, wherein the click carrier ring is made of synthetic material and is molded into a groove in the fixed bezel.

8. A watch as climed in claim 5, wherein said beairng surface on the fixed bezel is formed on an extension of the click carrier ring, said ring is made of synthetic material and is secured by adhesive bonding to a cylindrical bearing surface on the fixed bezel.

9. A watch as claimed in claim 5, wherein the click carrier ring is split and is provided with a snug cooperating with a socket in the middle in order to secure it against rotation.

10. A watch as claimed in claim 5, wherein the fixed bezel is composed of two parts joined axially by screws, and wherein the click carrier ring is held by being gripped between these two parts.

* * * * *